US009422771B2

(12) United States Patent
Jones et al.

(10) Patent No.: US 9,422,771 B2
(45) Date of Patent: Aug. 23, 2016

(54) REVERSE CIRCULATION BIT ASSEMBLY

(71) Applicant: Newtech Drilling Products, LLC, Salt Lake City, UT (US)

(72) Inventors: Mark L. Jones, Draper, UT (US); Kenneth M. Curry, South Jordan, UT (US); Jeffery T. Ross, Salt Lake City, UT (US); Kyle E. Johnson, Murray, UT (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 668 days.

(21) Appl. No.: 13/654,268

(22) Filed: Oct. 17, 2012

(65) Prior Publication Data

US 2013/0133956 A1 May 30, 2013

Related U.S. Application Data

(60) Provisional application No. 61/548,037, filed on Oct. 17, 2011.

(51) Int. Cl.

| | |
|---|---|
| ***E21B 10/60*** | (2006.01) |
| ***E21B 10/18*** | (2006.01) |
| ***E21B 21/10*** | (2006.01) |

(52) U.S. Cl.

CPC ..... *E21B 10/60* (2013.01); *E21B 10/18* (2013.01); *E21B 21/10* (2013.01); *Y10T 29/49716* (2015.01); *Y10T 29/49826* (2015.01); *Y10T 29/49881* (2015.01)

(58) Field of Classification Search

CPC ..... E21B 21/12; E21B 10/18; E21B 21/10; E21B 21/002; E21B 10/00; E21B 10/60; E21B 17/1092; Y10T 29/49716; Y10T 29/49826; Y10T 29/49881

USPC ..... 175/215, 339, 393

See application file for complete search history.

(56) References Cited

U.S. PATENT DOCUMENTS 3,416,617 A * 12/1968 Elenburg ..... 175/339
3,416,618 A * 12/1968 Kunnemann ..... 175/339

(Continued)

FOREIGN PATENT DOCUMENTS

CN 1632277 A 6/2005
CN 101215955 A 7/2008

OTHER PUBLICATIONS

International Search Report and Written Opinion for corresponding International Application No. PCT/US2012/060647, dated May 24, 2013 (11 pages).

(Continued)

*Primary Examiner* — Daniel P Stephenson

(74) *Attorney, Agent, or Firm* — Brinks Gilson & Lione; John C. Bacoch

(57) ABSTRACT

A drill bit assembly for boring including a drill bit and a bit sub. A front bit end has a plurality cutting elements at a forward face of the front bit end and a first fluid return passage extending through the drill bit to a rear bit end. The bit sub couples to the rear bit end. The bit sub includes a bore disposed at a front sub end sized and shaped to receive the rear bit end of the drill bit. A plurality of legs extends from a mid-sub region toward the front sub end between pairs of cutting elements. The plurality of legs has a fluid delivery passage disposed therein with the fluid delivery passage extending from the plurality of legs to a rear sub bit end. The bit sub has a second fluid return passage connecting the first fluid return passage to the rear sub bit end.

22 Claims, 11 Drawing Sheets

(56) References Cited

U.S. PATENT DOCUMENTS

| | | | | |
|---|---|---|---|---|
| 3,439,757 | A * | 4/1969 | Elenburg | 175/325.1 |
| 3,542,144 | A * | 11/1970 | White | 175/339 |
| 3,596,720 | A * | 8/1971 | Elenburg | 175/69 |
| 4,293,048 | A | 10/1981 | Kloesel, Jr. | |
| 5,012,876 | A | 5/1991 | Bruchmiller | |
| 6,095,261 | A * | 8/2000 | Trevino, Jr. | 175/57 |
| 6,408,957 | B1 | 6/2002 | Slaughter et al. | |
| 7,090,018 | B2 * | 8/2006 | Livingstone | 166/312 |
| 8,869,916 | B2 * | 10/2014 | Clausen et al. | 175/61 |
| 8,978,786 | B2 * | 3/2015 | Nguyen et al. | 175/336 |
| 2002/0108788 | A1 | 8/2002 | Peterson et al. | |
| 2003/0173088 | A1 * | 9/2003 | Livingstone | 166/324 |
| 2013/0133956 | A1 * | 5/2013 | Jones et al. | 175/393 |

OTHER PUBLICATIONS

First Office Action in corresponding Chinese Application No. 201280051146.8, dated Jul. 3, 2015 (18 pages).

* cited by examiner

REVERSE CIRCULATION BIT ASSEMBLY

PRIORITY CLAIM

This application claims the benefit of and priority from U.S. Provisional Patent Application No. 61/548,037 filed on Oct. 17, 2011, that is incorporated in its entirety for all purposes by this reference.

FIELD

The present application relates to drill bits used for earth boring, such as water wells; oil and gas wells; injection wells; geothermal wells; monitoring wells, mining; and, other operations in which a well-bore is drilled into the Earth.

BACKGROUND

Specialized drill bits are used to drill well-bores, boreholes, or wells in the earth for a variety of purposes, including water wells; oil and gas wells; injection wells; geothermal wells; monitoring wells, mining; and, other similar operations. These drill bits come in two common types, roller cone drill bits and fixed cutter drill bits.

Wells and other holes in the earth are drilled by attaching or connecting a drill bit to some means of turning the drill bit. In some instances, such as in some mining applications, the drill bit is attached directly to a shaft that is turned by a motor, engine, drive, or other means of providing torque to rotate the drill bit.

In other applications, such as oil and gas drilling, the well may be several thousand feet or more in total depth. In these circumstances, the drill bit is connected to the surface of the earth by what is referred to as a drill string and a motor or drive that rotates the drill bit. The drill string typically comprises several elements that may include a special down-hole motor configured to provide additional or, if a surface motor or drive is not provided, the only means of turning the drill bit. Special logging and directional tools to measure various physical characteristics of the geological formation being drilled and to measure the location of the drill bit and drill string may be employed. Additional drill collars, heavy, thick-walled pipe, typically provide weight that is used to push the drill bit into the formation being drilled. Finally, drill pipe connects these elements, the drill bit, down-hole motor, logging tools, and drill collars, to the surface where a motor or drive mechanism turns the entire drill string and, consequently, the drill bit, to engage the drill bit with the geological formation to drill the well-bore deeper.

A standard roller cone drill bit 202 is shown in FIG. 3. In FIG. 3, the roller cone drill bit 202 is comprised of a body 300 having a shank 302 and a plurality of legs 304. Although not shown in FIG. 3, the shank 302 has an external thread for connection to an adjacent drill string component. A bore 310 extends from the shank 302 through the body 300 of the roller cone bit 202. The legs 304 extend towards the front of the roller cone bit 202 and have a roller cone 306 disposed at an end of the leg 304. Although not illustrated, each roller cone 306 has at least one cutter disposed on an external surface of the roller cone 306 for degrading a formation. The cutters may be formed of a hardened material or have a coating of a hard material such as polycrystalline diamond. The roller cones 306 have a central axis about which they rotate, with the roller cone 306 being rotatably connected to the leg 304.

As a bore hole is drilled, fluid, typically a water or oil based drilling fluid referred to as drilling mud, is pumped down the drill string through the drill pipe and any other elements present and through the drill bit. Other types of drilling fluids are sometimes used; including air, nitrogen, foams, mists, and other combinations of gases, fluids, and mixtures of gases and fluids, but for purposes of this application, drilling fluid and/or drilling mud refers to any type of drilling fluid, including gases, fluid, and combinations thereof. In other words, drill bits typically have a fluid channel within the drill bit to allow the drilling mud to pass through the bit and out one or more jets, ports, or nozzles. The purpose of the drilling fluid is to cool and lubricate the drill bit, to stabilize the well-bore from collapsing, to prevent fluids present in the geological formation from entering the well-bore, and to carry fragments or cuttings removed by the drill bit up the annulus and out of the well-bore.

In a standard roller cone bit, drilling fluid is pumped to a working face 308 of the roller cone bit 202 through the drill string to the roller cone drill bit 202. The fluid flows through the bore 310 of the roller cone drill bit 202 to the roller cones 306 and around the roller cone bit 202. The drilling fluid returns up an annulus (the space between the exterior of the drill pipe and the wall of the well-bore). As the drilling fluid flows from the working face 308 to the outside of the roller cone bit 202, the drilling fluid carries cuttings from the formation away from the roller cone bit 202.

It may be beneficial in some situations to reverse the circulation of the drilling fluid. In such situations the drilling fluid is pumped down the annulus of the well-bore, across the face of the drill bit, and into the inner fluid channels of the drill bit through and up into the interior of the drill string. Alternatively, the drill string may have at least one section of double-wall pipe. Double wall pipe has an inner passage defined by an inner surface of the inner wall of the pipe and an outer passage defined by the outer surface of the inner wall and the inner surface of the outer wall. The drilling fluid may then be pumped down the outer passage and exit the exterior of the drill string proximate the drill bit. The drilling fluid then returns through the inner passage. It is also possible for the fluid to be pumped down the inner passage and crossover to the outer passage prior to the drill bit where the drilling fluid exits the drill string.

In either situation, the drilling fluid being pumped down the annulus or the drilling fluid being pumped down the outer passage of the double wall pipe, the drilling fluid does not necessarily pass across the face of the drill bit. Often much of the drilling fluid bypasses the face of the drill bit and flows to the inner channels of the drill bit through other paths, such as between the legs in the roller cone bit. To direct more of the fluid to the face of the roller cone bit, extensions may be welded to the roller cone bit between each of the legs. However, the process of welding the extensions may heat the bearings and seals of the roller cones affecting the longevity of the drill bit. Thus there is a need for a way to direct more of the fluid to the face of an existing roller cone drill bit without detrimentally affecting the longevity of the drill bit.

SUMMARY

Embodiments of the present invention include a drill bit assembly for earth boring. The drill bit assembly includes a drill bit and a bit sub. The drill bit has a front bit end and a rear bit end. The front bit end has a plurality cutting elements at a forward face of the front bit end and a first fluid return passage extending through the drill bit to the rear end. The bit sub is disposed about the rear bit end and couples to the rear bit end. The bit sub includes a body with a front sub end, a rear sub end, and a bore disposed at the front sub end sized and shaped to receive the rear bit end of the drill bit. The rear sub end is adapted to connect to an adjacent downhole component, such as a drill pipe. A plurality of legs extends from a mid sub region toward the front sub end between pairs of cutting elements. The plurality of legs preferably have a fluid delivery passage disposed therein with the fluid delivery passage extending from the plurality of legs to the rear sub bit end. The bit sub has a second fluid return passage connecting the first fluid return passage to the rear sub bit end with the second fluid return passage preferably being isolated from the fluid delivery passage within the bit sub.

In another embodiment, a bit sub includes a body, a plurality of legs, and a fluid return passage. The body has a front end, a rear end, and a bore disposed at the front end sized and shaped to receive a drill bit. The rear end is adapted to connect to an adjacent downhole component. The plurality of legs extends from the front end and has a forward end. The plurality of legs is adapted to complement an outer surface of the drill bit. Each of the plurality of legs has a fluid delivery passage disposed therein with the fluid delivery passage extending from the forward end to the rear sub bit end. The fluid return passage connects to the bore sized and shaped to receive a drill bit and is isolated from the fluid delivery passage within the body.

In another embodiment, a method of fabricating a reverse circulation drill bit assembly from a standard drill bit includes providing a standard drill bit and a bit sub component. The standard drill bit includes a shank and the bit sub component has a plurality of legs extending from a front end of the bit sub component. The shank is inserted into bit sub component such that the plurality of legs extends past the shank to a working surface of the drill bit. The bit sub component is then secured to the drill bit.

BRIEF DESCRIPTION OF THE DRAWINGS

To further clarify the above and other advantages and features of the one or more present inventions, reference to specific embodiments thereof are illustrated in the appended drawings. The drawings depict only typical embodiments and are therefore not to be considered limiting. One or more embodiments will be described and explained with additional specificity and detail through the use of the accompanying drawings in which.

The drawings are not necessarily to scale.

DETAILED DESCRIPTION

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are and will be understood by those of ordinary skill in the art to encompass obvious improvements and modifications thereto.

Additional advantages of the present invention will become readily apparent from the following discussion, particularly when taken together with the accompanying drawings.

Figure 1:
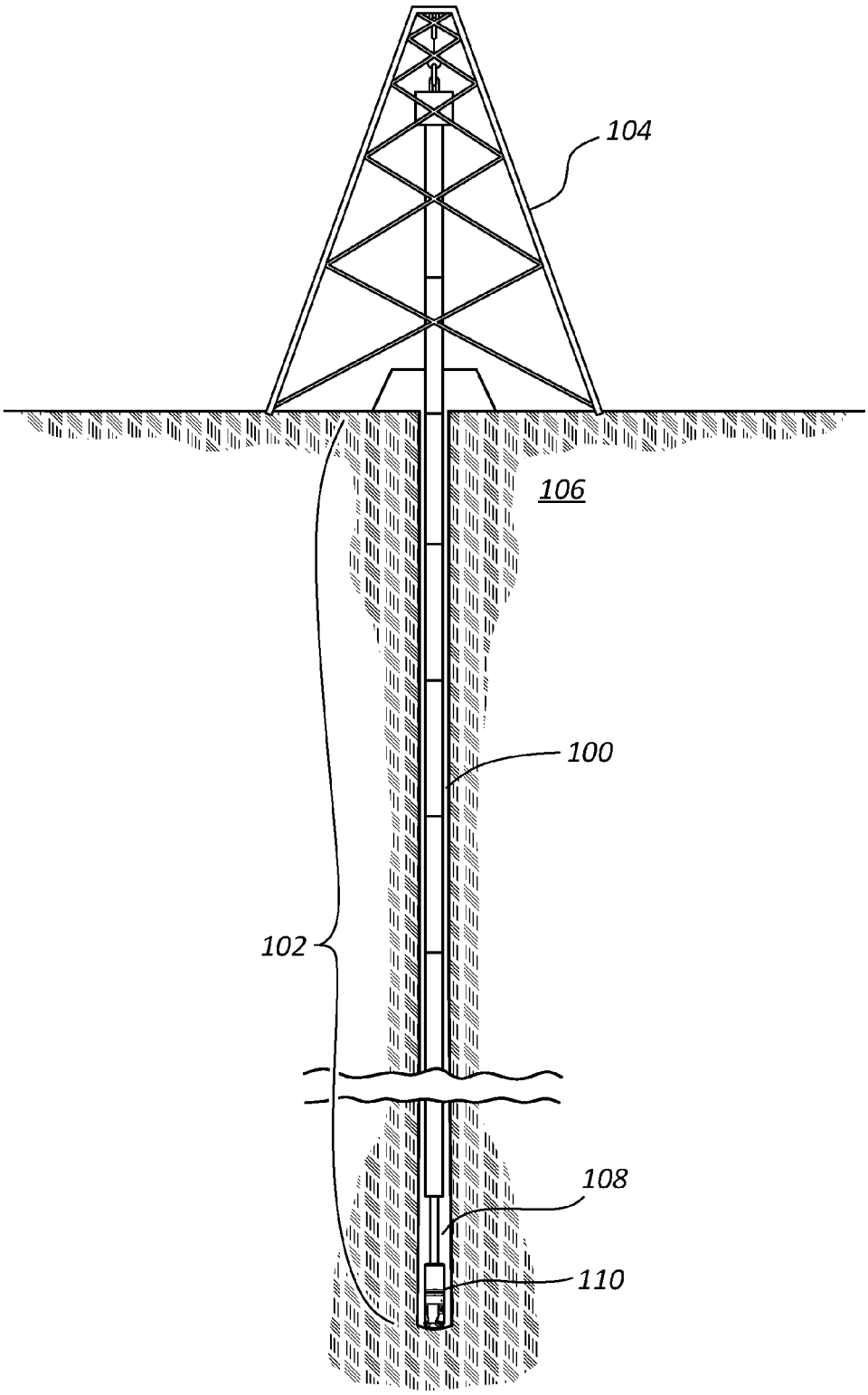
FIG. 1 illustrates a schematic of a cross-section of a bore hole having a drill string compatible with embodiments of the present invention.

FIG. 1 illustrates a schematic of a cross-section of a borehole 100 having a drill string 102 disposed therein. A derrick 104 connects the drill string 102 to the top surface of an earthen formation 106. The drill string 102 is comprised of a plurality of down-hole tool components, such as pipe segments, measuring tools, and drill bits. The pipe segments have an inner bore providing a passageway for fluid to be transferred through the drill string. The pipe segments may be double walled providing two separate passages for fluid. An annulus 108 is formed between the drill string 102 and an inner wall of the borehole 100. A drill bit 110 disposed at the bottom of the drill string 102. Movement of the drill bit 110 degrades the formation 106 allowing the drill string 102 to proceed further into the formation 106.

Figure 2:
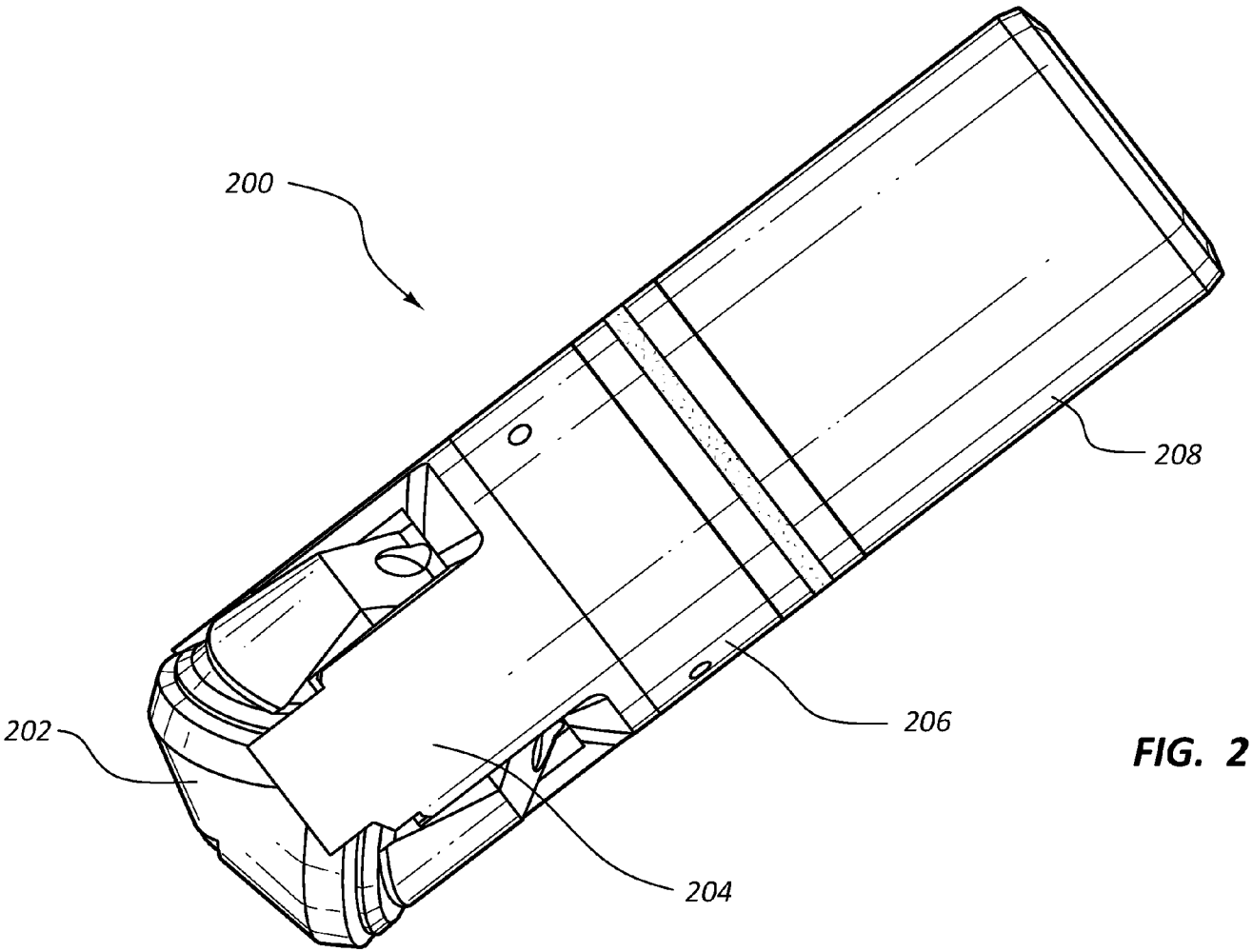
FIG. 2 illustrates a reverse flow bit assembly in accordance with an embodiment of the current invention.

FIG. 2 illustrates an embodiment of a reverse circulation bit assembly 200. The reverse circulation drill bit assembly 200 is generally comprised of a roller cone bit 202 and a skirt 204. The reverse circulation bit assembly 200 further comprises a nut section 206 and a check valve section 208. In the embodiment of FIG. 2 the skirt 204, the nut section 206, and the check valve section 208 are shown as three distinct parts, but in some embodiments they may be combined with one another so as to have less than three distinct components. The skirt 204, the nut section 206, and the check valve section 208 are generally referred to as a bit sub, whether they are distinct components or combined. Furthermore, the skirt 204, the nut section 206, or the check valve section 208 may each be comprised of individual parts making up that component.

Figure 3:
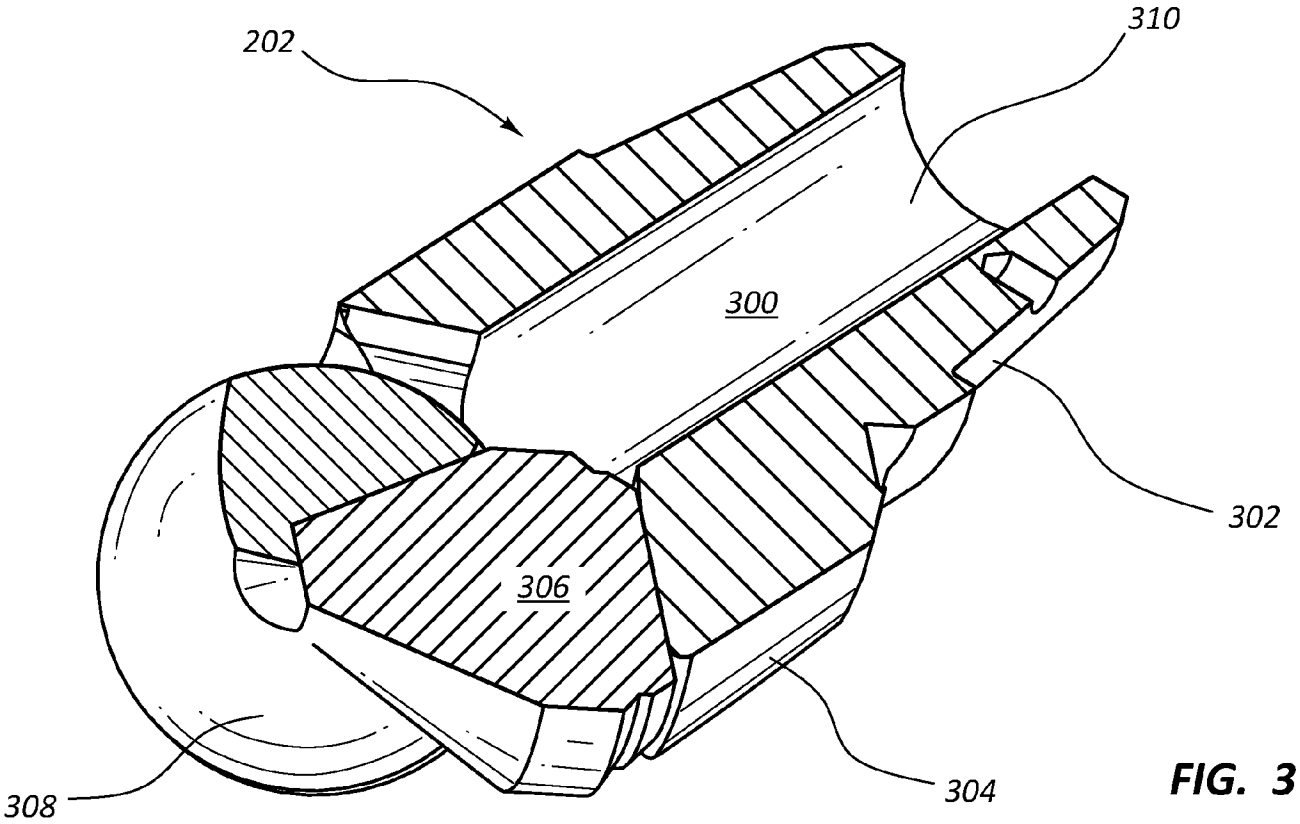
FIG. 3 illustrates a cross section of a three cone roller cone bit used in reverse flow bit assembly of FIG. 2.

FIG. 3 illustrates the roller cone bit 202 of FIG. 2 in more detail. The illustrated roller cone bit 202 is a standard three cone roller cone bit. However, other types of bits may be used in the reverse circulation bit assembly 200 and embodiments are not limited to three cone roller cone bits. The bits may be off the shelf parts and modified to become a reverse circulation bit assembly.

The operation of the roller cone bit of FIG. 3 was previously described as a standard circulation drill bit. Using embodiments of the current invention, the roller cone bit of FIG. 3 can be used as a reverse circulation drill bit. Embodiments of the current invention enable most drill bits to be used as a reverse circulation drill bit.

Figure 4:
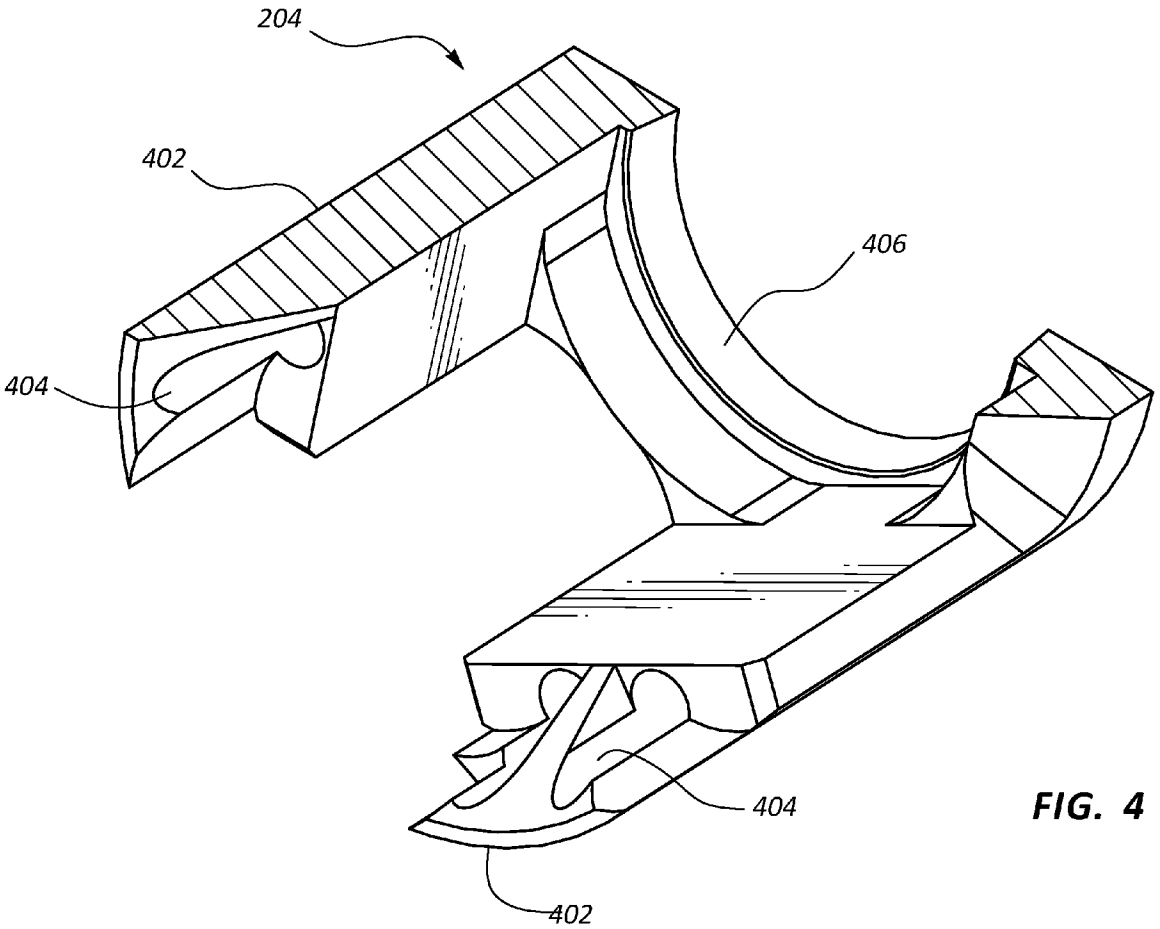
FIG. 4 illustrates a cross section of a skirt section used in the reverse flow bit assembly of FIG. 2.

FIG. 4 illustrates a cross-section of the skirt 204. The skirt 204 enables the standard roller cone bit 202 to be used as a reverse circulation bit. The skirt 204 has a plurality of legs 402 that extend towards the working face 308 of the roller cone bit 202. Each leg 402 is sized and shaped to fit closely around and between the roller cone bit legs 304. In some embodiments, the roller cone bit legs 304 may be modified to have a profile that is complementary to that of the skirt legs 402, or in other embodiments the roller cone bit legs 304 may be unmodified and the skirt legs 402 may have been modified to complement the profile of the roller cone bit legs 304. In some embodiments, a combination of modifying the roller cone bit legs 304 and the skirt legs 402 may be used.

At least one skirt leg 402 has a passageway 404 through which drilling fluid can be delivered. The passageway 404 exits the skirt leg 402 proximate the working face 308 of the roller cone bit 202. Since the drilling fluid is provided at the working face 308, the drilling fluid is more likely to flow across the working face 308 and then into the bore 310 of the roller cone bit 202, as opposed to flowing closer to the roller cone bit legs 304 without the skirt 204.

The skirt 204 is sized and shaped to slide over the roller cone bit 202 such that the skirt legs 402 are proximate the roller cones 306. The skirt 204 has a central bore 406 sized and shaped to complement the outer surface of the bit body 300. In some embodiments, the skirt 204 may press fit over the bit body 300.

Figure 5:
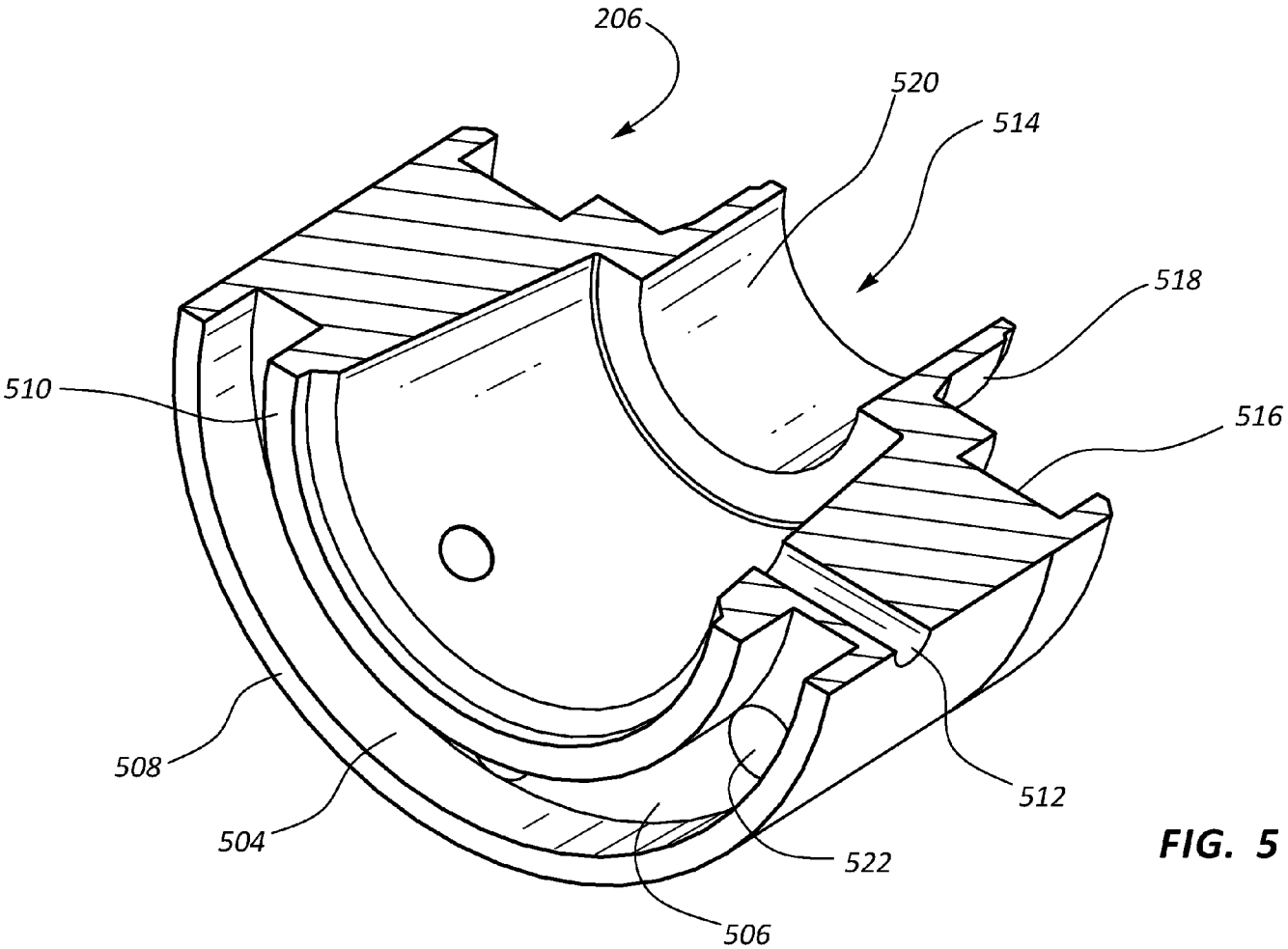
FIG. 5 illustrates a cross section of the nut section used in the reverse flow bit assembly of FIG. 2.

FIG. 5 illustrates a cross-sectional view of the nut section 206 of the reverse circulation bit assembly 200. The nut section 206 secures the skirt 204 to the roller cone bit 202. The nut section 206 includes an internal surface having an internal thread sized and shaped to complement the external thread of the roller cone bit shank 302. As the roller cone shank 302 is threaded into internal thread of the nut section 206, the nut section 206 advances towards the working face 308 of the roller cone bit 202. The skirt 204 is unable to advance past the front of the roller cone bit 202 and forms a stop for the nut section 206. When a rear surface of the skirt 204 contacts a forward surface 504 of the nut section 206, the nut section 206 can advance no further. The skirt 204 is then constrained from forward movement by the roller cone bit 202 and rearward movement by the nut section 206.

The nut section 206 includes a trough 506 disposed in the forward surface 504. The trough 506 is annular and the forward surface forms an inner sealing surface 510 and an outer sealing surface 508 about the trough 506. When the rear surface of the skirt 204 and the forward surface 504 of the nut section 206 contact one another, a seal is formed between the skirt 204 and the nut section 206 such that the trough 506 forms a front annular passageway. The through bores 404 from the legs 402 of the skirt 204 extend through the back of the skirt 204 such that the through bores 404 are fluidly connected with the trough 506 forming the front annular passageway. As the nut section 206 is threaded onto the roller cone bit 202 with the skirt 204 in place, the angular position of the nut assembly 206 relative to the skirt 204 is unimportant, as the through bores 404 will always line up with the trough 506 forming the front annular passageway.

The nut section 206 may have at least one side bore 512 through which a set screw or pin can be inserted to secure the nut section 206 to the roller cone bit 202. A matching side bore can me be machined in the roller cone bit 202 to receive the set screw or pin to prevent the roller cone bit 202 from rotating relative to the nut section 206. The matching side bore may be machined prior to the nut section 206 being threaded on the roller cone bit 202, or the matching side bore may be machined after the nut section 206 is threaded on the roller cone bit 202. In some embodiments, no matching side bore may be present and the set screw or pin may press into the shank 302 of the roller cone bit 202. Other means of securing the nut section or the entire bit sub to the bit may be employed.

A rear end 514 of the nut section 206 includes a rear annular trough 516 and a center protrusion 518. A nut section bore 520 extends from the forward surface 504 of the nut section 206 to the rear end 514 of the center protrusion 518. The nut section bore 520 aligns with the bore 310 of the roller cone bit 204 and provides a passage for the return of drilling fluid. The rear annular trough 516 and the front annular trough 506 are connected by at least one through passage 522. The through passage 522 enables fluid communication between the rear annular trough 516 and the forward annular trough 506.

Figure 6:
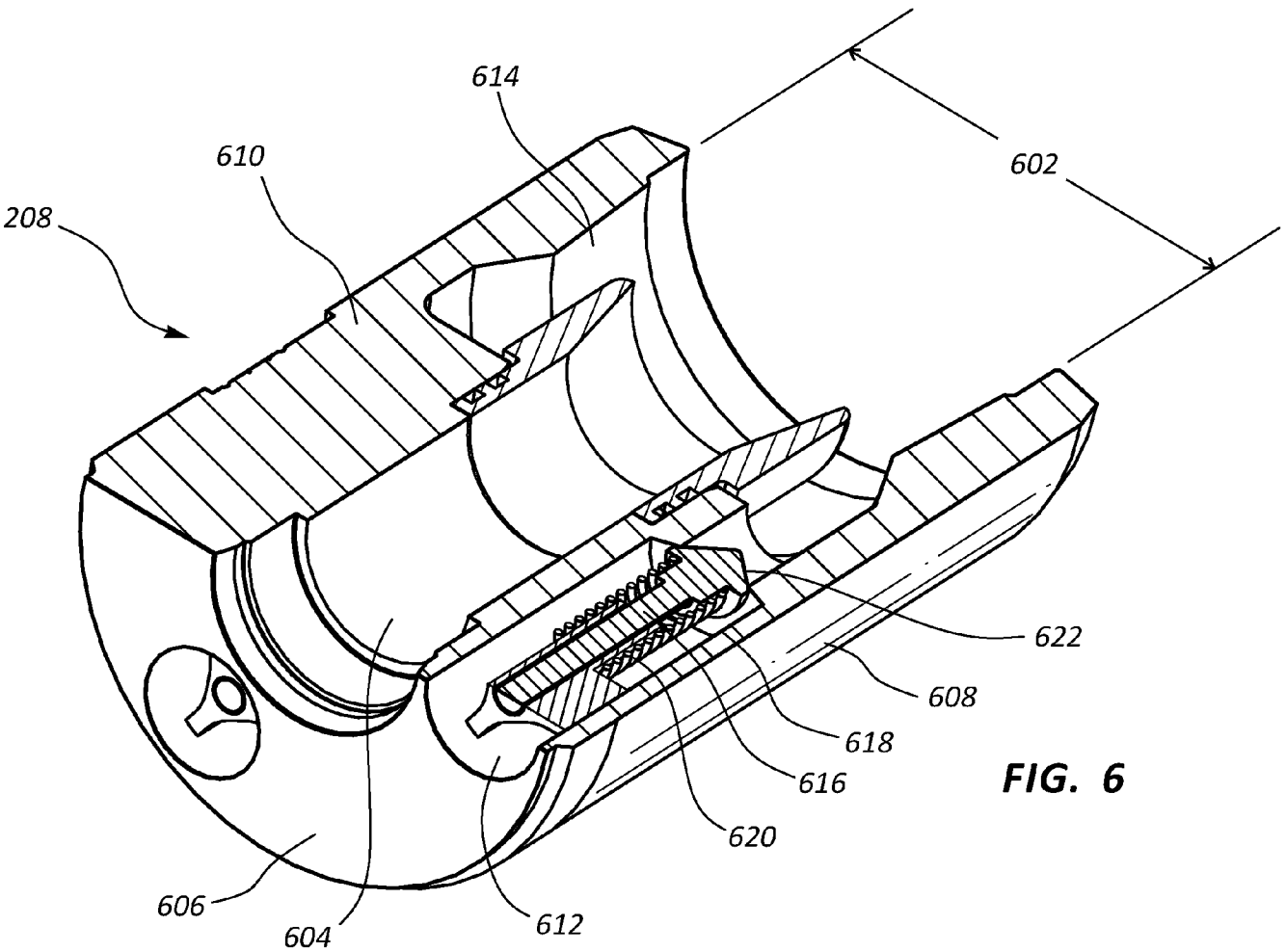
FIG. 6 illustrates a cross section of a check valve section used in the reverse flow bit assembly of FIG. 2.

FIG. 6 illustrates a cross-sectional view of the check valve section 208. The check valve section 208 is generally cylindrical with an outer diameter 602 similar to that of the nut section 206 and the skirt section 204. The check valve section 208 has a central bore 604 that extends from a front face 606 of the check valve section 208 to the rear of the check valve section 208. A wall 610 is formed between the central bore 604 and an outer surface 608 of the check valve section 208. Disposed within the wall 610 is at least one check valve passageway 612 providing fluid communication to the front face 606 of the check valve section 208. The rear of the check valve section 208 has an enlarged bore 614 that extends from the rear of the check valve section 208 to about mid-way the length of the check valve section 208.

Disposed within the check valve passageway 612 is a check valve assembly 616. The check valve assembly 616 inhibits drilling fluid from flowing up the check valve passageway 612. Although different types of check valves assemblies are compatible with the present embodiments, the check valve assembly 616 of FIG. 6 comprises a seat 618, a biasing member 620, and a piston 622. The biasing member 620 biases the piston 622 into the seat 618 forming a seal. When a pressure differential across the seal is sufficient to overcome the bias of the biasing member 620, the piston 622 moves against the bias, opening the valve.

The front face 606 of the check valve section 208 is coupled to the rear face of the nut section 206. The front face 606 may be coupled by way of a welded connection or other connection means. The front face 606 seals to the rear annular trough 516 of the nut section 206 forming a rear annular passage. Like the relation between the nut assembly 206 and the skirt 202, the angular position of the nut section 206 relative to the check valve section 208 is unimportant, as the check valve passageway 612 will always line up with the rear annular passageway.

Figure 7:
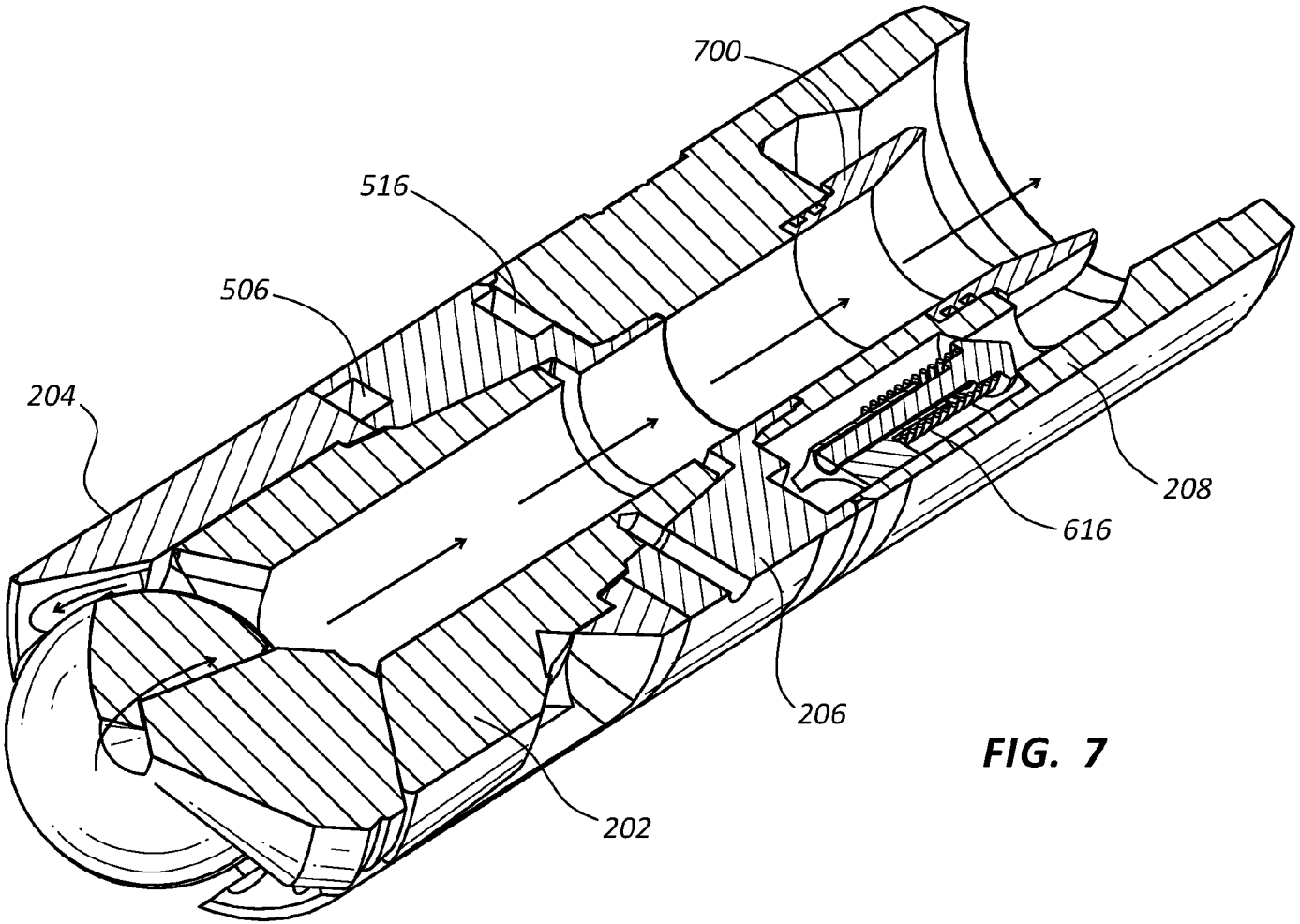
FIG. 7 illustrates a cross section of the reverse circulation drill bit assembly of FIG. 2 showing the flow of drilling fluid.

As shown in FIG. 7, an inner tube flange 700 is disposed within the enlarged bore 614. The inner tubular flange 700 may be threaded into the check valve section 208. The inner tubular flange 700 has an outer surface, an inner surface, and a wall there between. The inner surface defines an inner tube flange bore that aligns with the central bore 604 of the check valve section 208 and provides fluid communication from the rear end of the check valve section 208 to the bore 502 of the nut section 206. The outer surface and the enlarged bore together define an annular passageway fluidly connecting the rear of the check valve section 208 and the check valve passageway 612.

The rear end of the check valve section 208 is adapted to be connected to a tool string. The tool string may be a double walled tool string having two separate fluid paths. The tool string connects to the rear end of the check valve section 208 and connects the two separate fluid paths to the annular passageway of the check valve section 208 and the central bore of the check valve section 208.

Although the bit sub was described with relation to the skirt 204, nut section 206, and check valve section 208, the check valve section 208 may be combined with the nut section 206. In some embodiments, the check valve section 208 may not include a check valve assembly 616. For example, in some instances a drill operator may not be concerned about back flow and the check valve assembly 616 may be eliminated. In such instances, it may be simpler to manufacture the nut section 206 and the check valve section 208 as a single component.

The operation of the reverse circulation drill bit will be explained in relation to FIG. 7, which is a cross section of the assembled reverse circulation drill bit assembly 200. Drilling fluid is delivered to the annular passageway fluidly connecting the rear of the check valve section 208 and the check valve passageway 612. The pressure of the drilling fluid generates a pressure differential across the check valve assembly 616, causing the check valve assembly 616 to open. The drilling fluid flows from the check valve passageway 612 into the annular passageway formed by the rear annular trough 516. The drilling fluid then flows from the rear annular trough 516 through the through passage 522 into the forward annular trough 506. The forward annular trough 506 is in fluid communication with the skirt leg passage way 404 and the drilling fluid flows into the skirt leg passageway 404.

From the skirt leg passageway 404, the drilling fluid is delivered to the working face 308 of the roller cone bit 202. The drilling fluid collects cuttings and other material and flows into the bore 310 of the roller cone bit 302. The bore 310 of the roller cone bit 202 is in fluid communication with the inner tube flange bore through the nut section bore 502 and the check valve section bore 604. The drilling fluid flows up the reverse flow bit assembly 200 and out of the inner tube flange bore.

Figure 8:
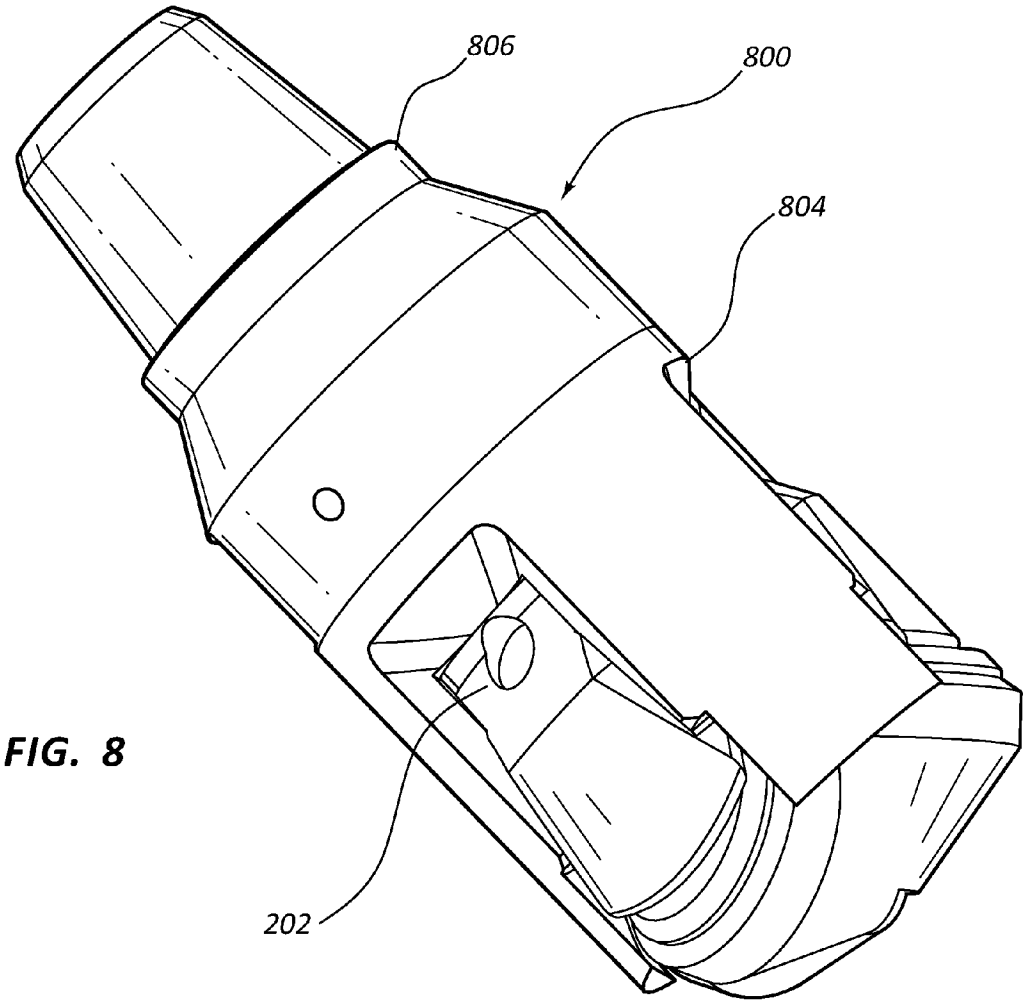
FIG. 8 illustrates a reverse flow bit assembly in accordance with an embodiment of the current invention.

FIG. 8 illustrates another embodiment of a reverse circulation drill bit assembly 800. The reverse circulation drill bit assembly 800 comprises a roller cone bit 202, a skirt section 804, and a nut section 806. In this embodiment, the drilling fluid is delivered to the annulus between the drill bit and the bore wall and not through the skirt as described in the previous embodiment.

Figure 9:
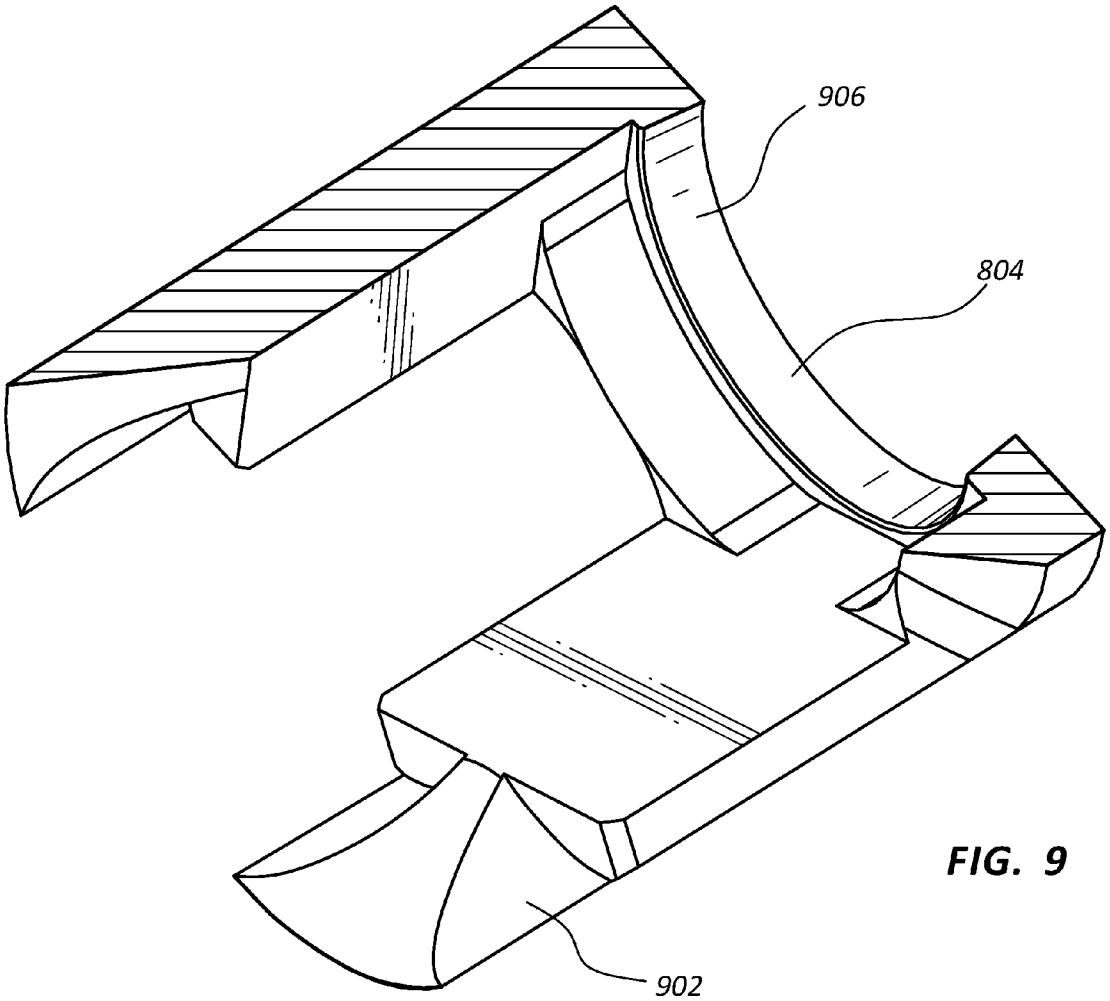
FIG. 9 illustrates a cross section of a skirt section used in the reverse flow bit assembly of FIG. 8.

FIG. 9 illustrates a cross-section of the skirt section 804 of the reverse circulation drill bit assembly 800. The skirt section has a plurality of legs 902 extending toward the working face 308 of the roller cone bit 202. Each leg 902 is sized and shaped to fit closely around and between the roller cone bit legs 304. In some embodiments, the roller cone bit legs 304 may be modified to have a profile that is complementary to that of the skirt legs 902, or in other embodiments the roller cone bit legs 304 may be unmodified and the skirt legs 902 may have been modified to complement the profile of the roller cone bit legs 304. In some embodiments, a combination of modifying the roller cone bit legs 304 and the skirt legs 902 may be used.

Unlike the previous embodiment, the skirt legs 902 do not have a passageway for the delivery of drilling fluid. Instead drilling fluid is delivered to the annulus of the drill bit and the skirt legs 902 inhibit the drilling fluid from flowing into the bore 310 of the roller cone bit 202 between the roller cone bit legs 304. Since the drilling fluid is inhibited from flowing into the bore until 310 it reaches the working face 308, the drilling fluid is more likely to flow across the working face 308 and into the bore 310 of the roller cone bit 202, as opposed to between the roller cone bit legs 304 without the skirt legs 902.

The skirt 804 is sized and shaped to slide over the roller cone bit 202 such that the skirt legs 902 are proximate the roller cones 306. The skirt 804 has a central bore 906 sized and shaped to complement the outer surface of the bit body 300. In some embodiments, the skirt 804 may press fit over the bit body 300.

Figure 10:
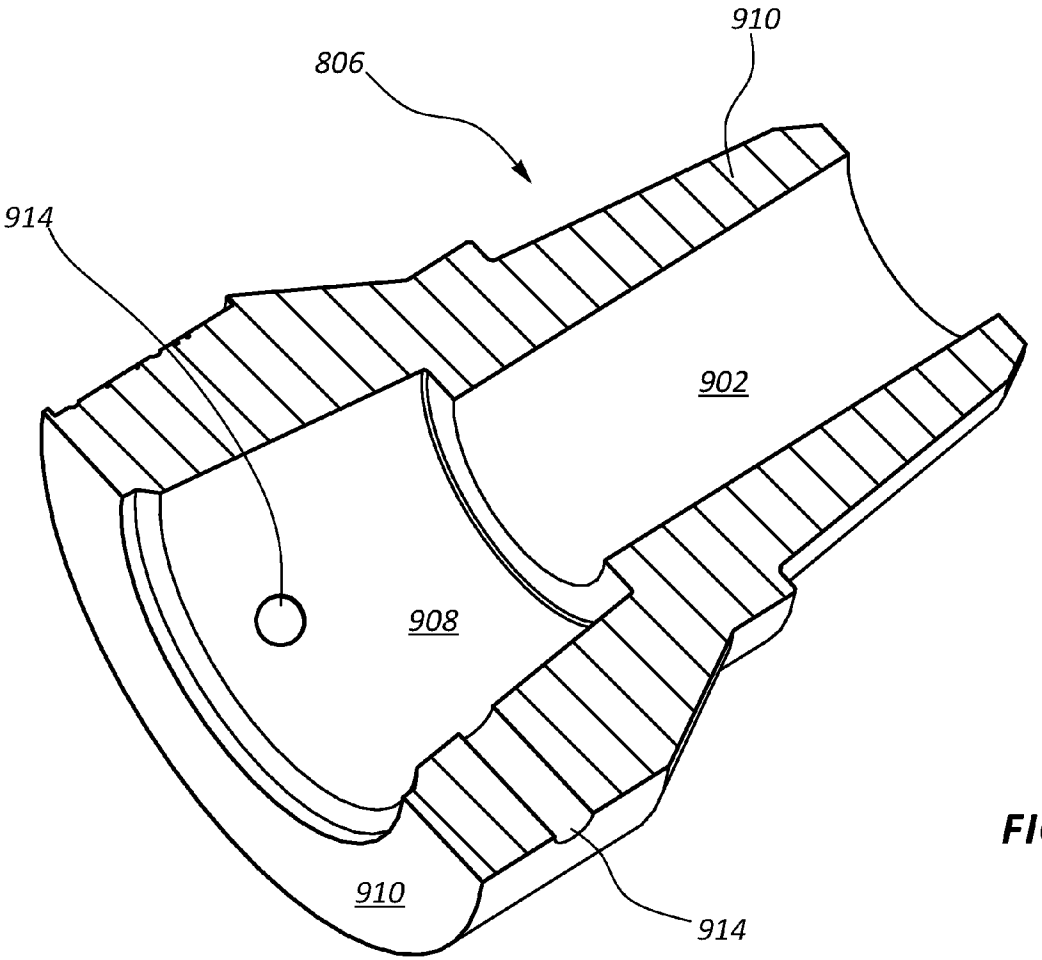
FIG. 10 illustrates a cross section of the nut section used in the reverse flow bit assembly of FIG. 8.

FIG. 10 illustrates a cross-sectional view of the nut section 806 of the reverse circulation bit assembly 800. The nut section 806 secures the skirt 804 to the roller cone bit 202 and provides a means for connecting the reverse circulation bit assembly 800 to the drill string. The nut section 806 includes an internal surface 908 having an internal thread sized and shaped to complement the external thread of the roller cone bit shank 302. As the roller cone shank 302 is threaded into internal thread of the nut section 806, the nut section 806 advances towards the working face 308 of the roller cone bit 202. The skirt 804 is unable to advance past the front of the roller cone bit 202 and forms a stop for the nut section 806. When a rear surface of the skirt 804 contacts a forward surface 910 of the nut section 806, the nut section 806 can advance no further. The skirt 804 is then constrained from forward movement by the roller cone bit 202 and rearward movement by the nut section 806.

The nut section 806 includes a shank 910 adapted to connect to a drill string. The shank 910 may have an external thread (not shown) for threading into a drill string. An internal bore 912 aligns with the bore 310 of the roller cone bit 202 and allows fluid to flow from the bore 310 of the roller cone bit 202 to a drill string bore. The nut section 806 may include a side bore 914 that may receive a set screw or pin that can be inserted to secure the nut section 806 to the roller cone bit 202. A matching side bore can be machined in the roller cone bit 202 to receive the set screw or pin to prevent the roller cone bit 202 from rotating relative to the nut section 806. The matching side bore may be machined prior to the nut section 806 being threaded on the roller cone bit 202, or the matching side bore may be machined after the nut section 806 is threaded on the roller cone bit 202. In some embodiments, no matching side bore may be present and the set screw or pin may press into the shank 302 of the roller cone bit 202. Other means of securing the nut section or the entire bit sub to the bit may be employed.

Figure 11:
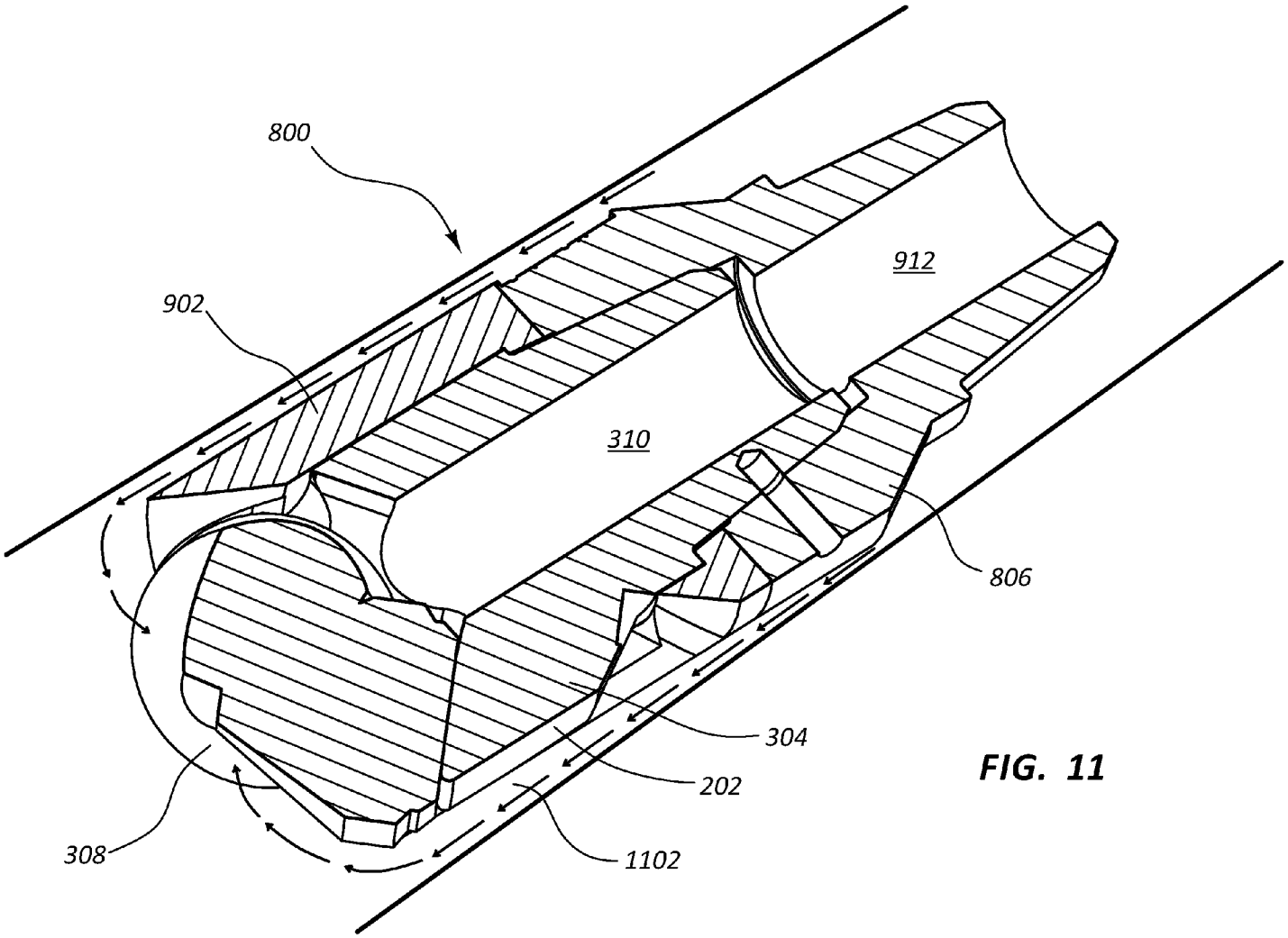
FIG. 11 illustrates a cross section of the reverse circulation drill bit assembly of FIG. 8 showing the flow of drilling fluid.

FIG. 11 illustrates a cross section of the reverse circulation drill bit assembly 800 and will be used to describe the reverse circulation of the drilling fluid. The direction of the flow of fluid is represented by the arrows on the figure. The drill fluid initially is delivered to the annulus 1202 and flows around the roller cone drill bit 202. Near the working face 308 the fluid is inhibited from flowing between the roller cone legs 304 by the skirt legs 902. The drilling fluid flow across the working face 308 and into the central bore 310 of the roller cone drill bit 202. The drilling fluid flows from the central bore 310 to the bore 912 of the nut section 904. From there the drilling fluid flows into the bore of the drill string.

The forgoing reverse flow bit assemblies 200, 800 can be manufactured using a standard, off the shelf drill bit. Embodiments of the invention include a method of making a reverse flow circulation bit assembly.

The method includes providing a standard drill bit. The standard drill bit may be a roller cone bit as previously described, or it may include a fixed blade bit or any other type of drill bit. A skirt sized and shaped to complement the drill bit is provided. In some embodiments the standard drill bit may be modified to complement the size and shape of the skirt or the skirt may be modified to complement the size and shape of the standard drill bit. The skirt is placed over the shank of the drill bit.

A nut assembly is then provided and coupled to the standard drill bit. In some embodiments the nut assembly may have a female thread that complements the shank of the standard drill bit. In such embodiments the nut assembly is threaded onto the shank until the nut assembly contacts the skirt, securing the skirt in place. A set screw or pin may then be inserted into the nut assembly to hold the drill bit in place. After the nut is in place, a check valve section may then be coupled to the nut assembly. Such a coupling may be performed by welding, a threaded connection, or some other means of connection. In other embodiments, the check valve section may be coupled to the nut section prior to the nut section being coupled to the standard drill bit. In some embodiments, the check valve section and the nut may be single components that are coupled to the standard drill bit.

An inner tube flange is provided and coupled to the rear end of the check valve section. The inner tube flange may be coupled to the rear end of the check valve section prior to the check valve section being coupled to the nut section, or it may be coupled after. In some embodiments the inner tube flange is an integral part of the check valve section and is not removable.

The inner tube flange may be sized and shaped for connection to a specific type of drill string. For example, different inner tube flanges may be used to connect the reverse circulation bit assembly with different drill pipes. In this way a single reverse circulation drill bit assembly may be compatible with multiple types of drill pipe.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A drill bit assembly for earth boring, the drill bit assembly comprising:

a drill bit having a front bit end and a rear bit end, the front bit end having a plurality of cutting elements at a forward face of the drill bit, and a first fluid return passage extending through the drill bit from the front bit end to the rear bit end;

a bit sub disposed about the rear bit end and coupled to the rear bit end, the bit sub comprising:

a nut component having a first end with a bore sized and shaped to receive the rear bit end of the drill bit in a threaded connection, a second end adapted to connect to an adjacent downhole component, and a second fluid return passage connecting the first fluid return passage to the second end; and a skirt component disposed between the nut component and the drill bit, the skirt component having a central bore sized and shaped to fit over a portion of the rear bit end and a plurality of legs extending from the skirt component toward the front bit end between pairs of cutting elements.

2. The drill bit assembly of claim 1 wherein the plurality of legs have a fluid delivery passage disposed therein, the fluid delivery passage extending from the plurality of legs to the nut component, wherein the fluid delivery passage is separated from the second fluid return passage.

3. The drill bit assembly of claim 2, wherein the bit sub further comprises a check valve component.

4. The drill bit assembly of claim 3 wherein the check valve component has an first inner surface, the drill bit assembly further comprising an inner tube component disposed in the check valve component, the inner tube component having a wall, a second inner surface, and an outer surface, wherein the second inner surface forms a portion of the second fluid return passage, and the first inner surface and the outer surface form a portion of the fluid delivery passage.

5. The drill bit assembly of claim 3 wherein the rear bit end has an external thread, and the nut component has an internal thread complementary to the external thread.

6. The drill bit assembly of claim 3 wherein the check valve component has a check valve disposed therein, the check valve being configured to restrict flow of fluid away from the nut component.

7. The drill bit assembly of claim 1, wherein the nut component is rotatable relative to skirt component.

8. The drill bit assembly of claim 1 wherein the bit sub has a wall and an inner surface, the inner surface defining the second fluid return passage, and a fluid delivery passage is disposed in the wall.

9. The drill bit assembly of claim 1 wherein each of the cutting elements are disposed on a bit leg having a bit leg profile and the plurality of legs extending from the skirt component toward the front bit end between pairs of cutting elements have a skirt profile complementary to the bit leg profile.

10. The drill bit assembly of claim 9 wherein the bit leg profile has been modified to complement the skirt profile.

11. The drill bit assembly of claim 9 wherein the skirt profile complements an drill bit leg profile.

12. The drill bit assembly of claim 9 wherein the skirt profile compliments a leg profile of a drill bit leg that has been modified.

13. The drill bit assembly of claim 9 wherein the plurality of legs extend beyond the bit legs.

14. The drill bit assembly of claim 1 wherein the cutting elements are roller cones.

15. A bit sub component comprising:

a body with a front bit sub end, a rear bit sub end, and a bore disposed at the front bit sub end sized and shaped to receive a drill bit, the rear bit sub end adapted to connect to an adjacent downhole component;

a plurality of legs extending from the front bit sub end toward a forward end, the plurality of legs adapted to complement an outer surface of the drill bit, and having a fluid delivery passage disposed therein, the fluid delivery passage extending from the forward end to the rear bit sub end; and a fluid return passage connecting the bore sized and shaped to receive the drill bit, the fluid return passage being isolated from the fluid delivery passage.

16. The bit sub component of claim 15, wherein the bit sub is formed from a plurality of components comprising:

a skirt component including the legs, the skirt component having a bore there through;

a nut component adjacent the skirt component, the nut component having an internal thread adapted to receive a drill bit;

a check valve component coupled to the nut component, the check valve component adapted to couple to an adjacent downhole component.

17. A method of fabricating a reverse circulation drill bit assembly from a drill bit, the method comprising:

providing a drill bit having a shank;

providing a bit sub component comprising a nut component and a skirt component having a plurality of legs extending skirt component;

inserting the shank through the skirt component and into nut component such that the plurality of legs extends past the shank to a working surface of the drill bit; and rotating the nut component relative to the shank to secure the drill bit through a threaded connection to the nut component with the plurality of legs extending past the shank to the working surface of the drill bit.

18. The method of claim 17 further comprising modifying a profile of the drill bit to complement a profile of the plurality of legs.

19. The method of claim 17 further comprising modifying a profile of the plurality of legs to complement a profile of the drill bit.

20. The method of claim 17 wherein the method further comprises sliding the skirt component over the shank such that the shank extends through the skirt prior to securing the drill bit to the nut component.

21. The method of claim 20 wherein the bit sub component further comprises a check valve component, the method further comprising coupling the nut component to the check valve component.

22. The method of claim 20 wherein the nut component has an inner flange sized and shaped to complement a dual wall drill string.

* * * * *